US010399143B2

(12) United States Patent
Boswell et al.

(10) Patent No.: US 10,399,143 B2
(45) Date of Patent: Sep. 3, 2019

(54) COMPONENT CASTING

(71) Applicant: ROLLS-ROYCE PLC, London (GB)

(72) Inventors: John Harold Boswell, Derby (GB); Terence Ivan Simpson, Derby (GB); Phillip John Crosby, Derby (GB)

(73) Assignee: ROLLS-ROYCE plc, London (GB)

( * ) Notice: Subject to any disclaimer, the term of this patent is extended or adjusted under 35 U.S.C. 154(b) by 723 days.

(21) Appl. No.: 14/729,912

(22) Filed: Jun. 3, 2015

(65) Prior Publication Data

US 2016/0001360 A1 Jan. 7, 2016

(30) Foreign Application Priority Data

Jul. 1, 2014 (GB) ..... 1411680.0

(51) Int. Cl.

| | |
|---|---|
| ***B22D 27/04*** | (2006.01) |
| ***B22C 9/04*** | (2006.01) |
| ***B22D 25/02*** | (2006.01) |
| ***B22D 25/06*** | (2006.01) |
| ***F01D 5/14*** | (2006.01) |

(52) U.S. Cl.

CPC ..... *B22D 27/045* (2013.01); *B22C 9/04* (2013.01); *B22D 25/02* (2013.01); *B22D 25/06* (2013.01); *F01D 5/141* (2013.01); *F05D 2220/30* (2013.01); *F05D 2230/21* (2013.01); *F05D 2260/22141* (2013.01)

(58) Field of Classification Search

CPC ..... B22C 9/04; B22D 25/02; B22D 25/06; B22D 27/04; B22D 27/045

USPC ..... 164/271, 361, 516, 122.1, 122.2

See application file for complete search history.

(56) References Cited

U.S. PATENT DOCUMENTS

2002/0157738 A1 10/2002 Burgel et al.
2007/0187117 A1* 8/2007 Tanaka et al. ..... B22F 5/007 172/1
2010/0276107 A1* 11/2010 Gauermann ..... B22C 9/067 164/253

FOREIGN PATENT DOCUMENTS

| | | | |
|---|---|---|---|
| EP | 1452251 | A1 | 9/2004 |
| FR | 2 874 340 | A1 | 2/2006 |
| GB | 2 432 133 | A | 5/2007 |
| JP | H1034280 | A | 2/1998 |
| JP | H10156484 | A | 6/1998 |

(Continued)

OTHER PUBLICATIONS

Dec. 23, 2014 Search Report issued in British Application No. GB1411680.0.

(Continued)

*Primary Examiner* — Kevin P Kerns
(74) *Attorney, Agent, or Firm* — Oliff PLC

(57) ABSTRACT

A method includes forming a mold, the mold having at least one mold portion defining the shape of an element to be removed from the component in a subsequent manufacturing step and having a reduced cross-sectional area. The at least one mold portion includes at least one recess which further reduces the cross sectional area of the cavity and increases the surface area of the at least one mold portion or the at least one mold portion includes a plurality of projections which increase the surface area of the least one mold portion thereby increasing radiative heat loss from the at least one mold portion during the process. A mold for use in this method and a turbine blade formed using this method, are also provided.

27 Claims, 5 Drawing Sheets

(56) References Cited

FOREIGN PATENT DOCUMENTS

| | | | |
|---|---|---|---|
| JP | 2002178133 | A | 6/2002 |
| JP | 2004058091 | A | 2/2004 |

OTHER PUBLICATIONS ecember 15, 2015 Search Report issued in European Patent Application No. 15170445.

* cited by examiner

COMPONENT CASTING

FIELD OF THE INVENTION

The present invention relates to component casting and, more particularly to component casting of directional solidification or single crystal components for engines such as a turbine blade having a portion with a reduced cross-sectional area e.g. a tang portion.

BACKGROUND OF THE INVENTION

The investment casting process is used to create metal components, e.g. turbine blades, by pouring molten metal into a ceramic shell of the desired final shape and subsequently removing the ceramic shell.

The process is an evolution of the lost-wax process whereby a component of the size and shape required in metal is manufactured using a wax pattern die into which molten wax is injected. The wax pattern is then dipped in ceramic slurry to create a ceramic shell on the wax pattern. The wax is removed and the shell fired to harden it. The resulting ceramic shell has an open cavity of the size and shape of the final component into which the metal can be poured. The ceramic shell is subsequently removed, either physically or chemically.

It is necessary to produce single crystal components for use in certain environments. For example, a turbine blade must be highly resistant to creep at high temperatures and so a single crystal with its absence of grain boundaries is the preferred structure.

In order to achieve such a single crystal structure, a technique called directional solidification is used. This involves use of a spiral, "pig-tail" selector to initiate single crystal or grain growth followed by subsequent withdrawal of the mould (e.g. the ceramic shell) containing the cooling cast component from a heating zone into a cooling zone (having a chill plate) within a vacuum furnace at a predetermined rate such that the temperature gradient within the cast component is closely controlled. Generally, the "mushy zone" at the interface between the molten and solid metal in the cooling casting must be a calm (stagnant) interface with a flat temperature gradient in order to achieve a single crystal structure with no discontinuities. This is difficult to achieve in a component having a varying cross-sectional area along its profile because the heat radiated from the component will vary along its profile and convective instabilities will occur in the molten metal. As a result, an unacceptable proportion of cast components are rejected as a result of defects (e.g. freckling or secondary grains) formed during casting.

It is known from EP1452251-A1 to provide a horizontally oriented, displaced radiation deflector element in a mould for component casting. The radiation deflector element acts to reduce heat transfer between downward facing surfaces of the cast component (above the portions having a reduced cross sectional area) and the chill plate in the cooling zone of the furnace during directional solidification by acting as a barrier between the heating and cooling zones and reflecting heat back into the downward facing surfaces in the heating zone. This helps control (increase) the temperature gradient across the "mushy zone" which, in turn, helps reduce defects in the single crystal component by reducing buoyancy-induced defects such as freckling, sliver grains or high angle grain boundaries.

It is a preferred aim of the present invention to further control (increase) the temperature gradient at the liquid/solid metal interface ("mushy zone") upon cooling of cast component having a portion with a reduced cross-sectional area e.g. a tang portion of a turbine blade.

SUMMARY OF THE INVENTION

In a first aspect, the present invention provides a method of component casting using a directional solidification process comprising forming a mould, the mould having at least one mould portion defining a cavity with a reduced cross-sectional area which defines the shape of an element to be removed from the component in a subsequent manufacturing step, wherein said at least one mould portion comprises at least one recess which further reduces the cross-sectional area of the cavity and increases the surface area of the at least one mould portion or wherein said at least one mould portion comprises a plurality of projections which increase the surface area of the least one mould portion thereby increasing radiative heat loss from said at least one mould portion during said process.

In a second aspect, the present invention provides a mould for component casting using a directional solidification process, said mould comprising at least one mould portion defining a cavity with a reduced cross-sectional area which defines the shape of an element to be removed from the component in a subsequent manufacturing step, wherein said at least one mould portion comprises at least one recess which further reduces the cross-sectional area of the cavity and increases the surface area of the at least one mould portion or wherein said at least one mould portion comprises a plurality of projections which increase the surface area of the least one mould portion, such that, in use, the radiative heat loss from said at least one mould portion during said process is increased.

In some embodiments, the element defined by the at least one mould portion may be a tang which serves not only to provide improved control of the temperature gradient, but can be used to support the component in post casting machining or surface finishing operations. The tang can be removed from the component as a subsequent post casting step in the manufacture of the finished component.

By providing the at least one mould portion with a recess, the thermal mass of the portion of the cast component contained with the mould portion is reduced and the surface area of the mould portion is increased such that, during cooling of the cast component in the directional solidification process, the amount and rate of radiative heat loss from the mould portion in the cooling zone is increased. Similarly, by providing a portion of the mould with a plurality of projections, the surface area of the mould portion is increased such that, during cooling of the cast component in the directional solidification process, the amount and rate of radiative heat loss from the mould portion in the cooling zone is increased. This helps control (increase) the thermal gradient across the liquid/solid interface thus limiting defects in the single crystal structure of the component.

Optional features of the invention will now be set out. These are applicable singly or in any combination with any aspect of the invention.

In some embodiments, there is a plurality of recesses in the at least one mould portion.

In some embodiments, the or each recess is an elongated recess (or slot). Where there is a plurality of recesses, the recesses may be a series of elongated recesses (or slots) separated by one or more interspaced elongated ribs on the mould portion.

The plurality of projections may be a series of elongated projections, e.g. elongated projecting ribs on the mould portion.

The interspaced elongated rib(s) or plurality of projections/elongated projecting ribs may have a semi-circular-, square- (optionally with rounded vertices), triangular-, trapezoidal-, or dovetail-shaped cross section (at 90 degrees to the direction of elongation). The cross-section shape and/or cross-sectional area may vary along the length of the or each rib.

The interspaced elongated rib(s) or plurality of projections/elongated projecting ribs may each have a through channel or bore to further increase the surface area of the mould portion.

The recess, recesses and interspaced rib(s) or at least one of said plurality of projections/elongated projecting ribs may be zig-zagged.

The or each recess may be branched with the branches at least partly surrounding a protrusion on the mould portion.

At least one of the plurality of projections/elongated projecting ribs may be branched.

In some embodiments, the elongated recess(es) or slot(s) or the plurality of projections/elongated projecting ribs is/are vertically aligned on the mould portion i.e. aligned with or parallel to the major axis of the mould. This major axis will be aligned with the vertical direction of withdrawal of the mould from the heating zone and aligned with the axis of the pig-tail selector.

In these embodiments, the radiation of heat from the increased surface area is predominantly towards the walls of the cooling zone rather than the chill plate (which is typically provided at the end face of the cooling zone (towards which the mould is withdrawn during the directional solidification process)). This is because the increased surface area of the mould portion faces the walls of the cooling zone rather than the chill plate i.e. there is an increased view factor towards the walls of the cooling zone rather than (downwards) towards the chill plate.

In other embodiments, the elongated recess(es) or slot(s) or the plurality of projections/elongated projecting ribs are aligned at an angle to the major axis of the mould. For example, they may be transversely aligned on the mould portion (i.e. at 90 degrees to the major axis of the mould) or they may be angled at angle less than 90 degrees, e.g. 45 degrees on the mould portion.

In some embodiments, the or each recess or at least one of the plurality of projections may be a shaped recess/projection e.g. circular-, ovular-, diamond- or dog-bone-shaped recess/projection. A series of these shaped recesses may be provided and the series of recesses or the plurality of projections may be parallel to and/or transversely aligned with the major axis of the mould portion.

The mould portion may have a posterior and anterior surface and the recess or series of recesses or plurality of projections/elongated projecting ribs as described above may be provided on one or both of said surfaces.

The posterior and anterior surfaces may be separated by at least one side surface. The or each recess or each of said plurality of projections/elongated projecting ribs on the anterior and/or posterior surface may terminate before the side surface i.e. the recess or each recess/projection/projecting rib may be entirely contained within the respective surface. Alternatively, the recess or each recess/projection/projecting rib may extend into said at least one side surface.

The mould may be for casting of a turbine blade and the mould may comprise a main body defining a cavity for forming a blade body. The mould portion defining the cavity with a reduced cross-sectional area may be for forming a tang portion of the turbine blade.

Accordingly, in a third aspect, the present invention provides a method for casting a turbine blade using a directional solidification process comprising forming a mould, the mould having a main body defining a cavity corresponding in shape to a blade body and at least one mould portion defining a cavity with a reduced cross-sectional area corresponding in shape to a tang portion, wherein said at least one mould portion comprises at least one recess which further reduces the cross sectional area of the tang portion cavity and increases the surface area of the at least one mould portion or wherein said at least one mould portion comprises a plurality of projections which increase the surface area of the least one mould portion thereby increasing radiative heat loss from said at least one mould portion during said process.

In a fourth aspect, the present invention provides a mould for casting a turbine blade using a directional solidification process, said mould comprising a main body defining a cavity corresponding in shape to a blade body and at least one mould portion defining a cavity with a reduced cross-sectional area corresponding in shape to a tang portion, wherein said at least one mould portion comprises at least one recess which further reduces the cross sectional area of the tang portion cavity and increases the surface area of the at least one mould portion or wherein said at least one mould portion comprises a plurality of projections which increase the surface area of the least one mould portion, such that, in use, the radiative heat loss from said at least one mould portion during said process is increased.

For the third and fourth aspects, the mould portion comprising at least one recess or a plurality of projections is as described with reference to the first and second aspects.

In some embodiments, the mould comprises two axially opposed mould portions defining cavities of reduced cross-sectional area corresponding in shape to the axially opposed tang portions.

One mould portion defining the tang portion cavity will be located between the main body and a selector portion, the selector portion defining a cavity corresponding to the shape of the pig-tail selector.

The anterior and posterior surfaces of the mould portion(s) defining the tang cavity/cavities may each have a tip which is trapezoid shaped (with the longest of the two parallel edges located proximal the main body of the mould). The angle of the two sloped edges may be between 50 and 70 degrees (preferably around 60 degrees) to the vertical (where the vertical is at 90 degrees to the parallel edges).

In a fifth aspect, the present invention provides a turbine blade formed according to the method of the first aspect and using a mould according to the second aspect.

After forming the turbine blade, the tang portion(s) are clipped from the blade body.

In a sixth aspect, the present invention provides a turbine blade having a blade body and at least one tang portion having an anterior and posterior surface where at least one of said surfaces comprises at least one recess or wherein said at least one of said surfaces comprises a plurality of projections.

The recessed tang has been found to retain its rigidity allowing its continued use for supporting the cast blade body during processing but with reduced metal content thus saving raw material costs during manufacturing.

In some embodiments, the turbine blade has two axially opposed recessed tang portions.

The anterior and/or posterior surface(s) of the tang portion(s) will include the recess(es)/plurality of projections/elongated projecting ribs described above for the mould portion of the first and second aspects (since the anterior/posterior surfaces of the mould portion(s) will define the anterior/posterior surfaces of the tang portions).

The tips of the anterior and posterior surfaces of the tang portion(s) may be trapezoid shaped (with the longest of the two parallel edges located proximal the blade body). The angle of the two sloped edges may be between 50 and 70 degrees to the vertical (where the vertical is at 90 degrees to the parallel edges).

In a seventh aspect, the present invention provides a turbine for a gas turbine engine, the turbine comprising a plurality of turbine blades according to the fifth or sixth aspect.

In an eighth aspect, the present invention provides a gas turbine engine having a turbine according to the seventh aspect.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
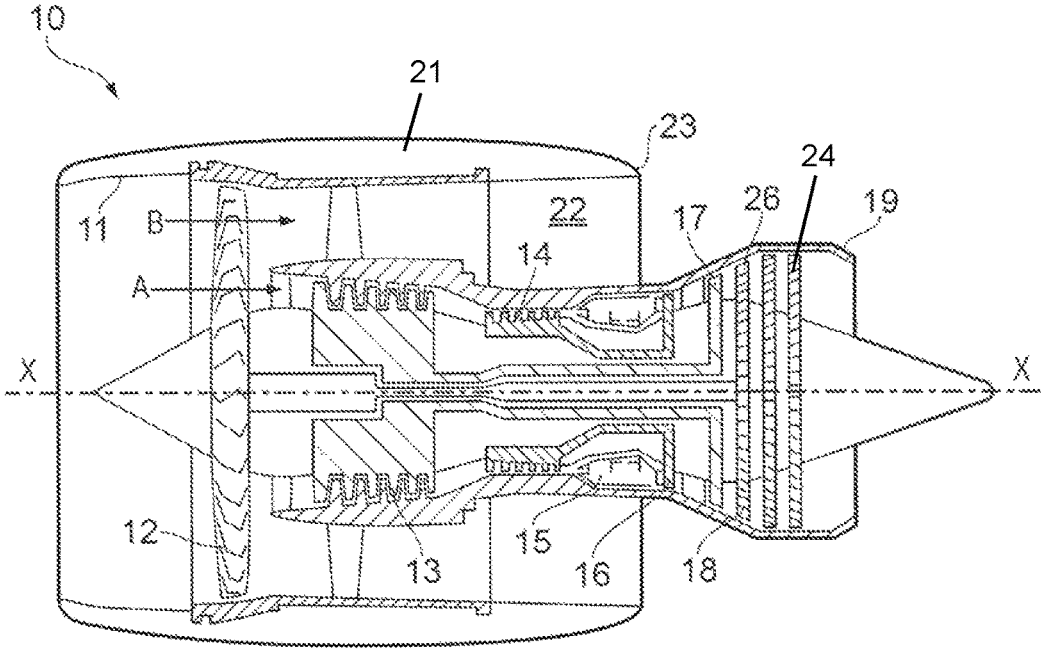
FIG. 1 shows a ducted fan gas turbine engine incorporating a series of turbines each having a plurality of aerofoil blades formed using a method according to an embodiment of the present invention.

With reference to FIG. 1, a ducted fan gas turbine engine incorporating a series of turbines each having a plurality of aerofoil blades formed using a method according to an embodiment of the present invention is generally indicated at 10 and has a principal and rotational axis X-X. The engine comprises, in axial flow series, an air intake 11, the propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The turbines 16, 17 and 18 each comprise a plurality of turbine blades 24 formed according to a first embodiment of the present invention.

Figure 2A:
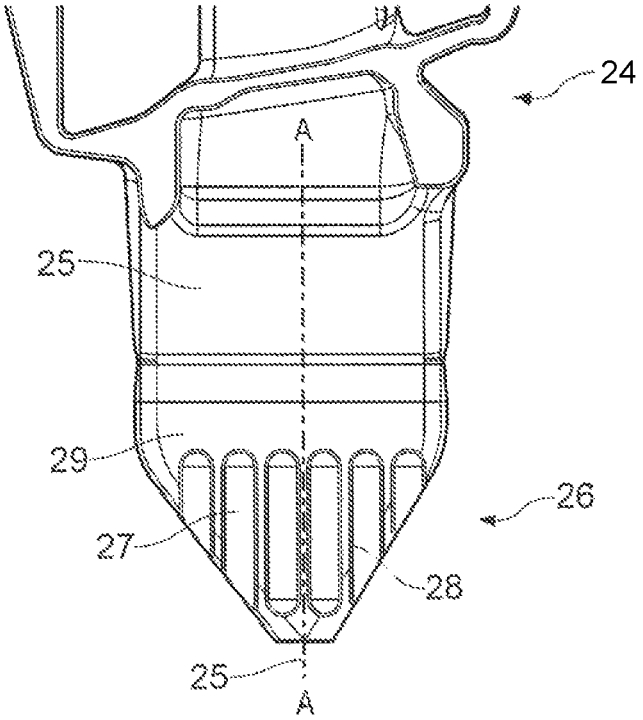
FIG. 2*a* shows a tang portion of a turbine blade cast using a method according to an embodiment of the present invention.
Figure 2B:
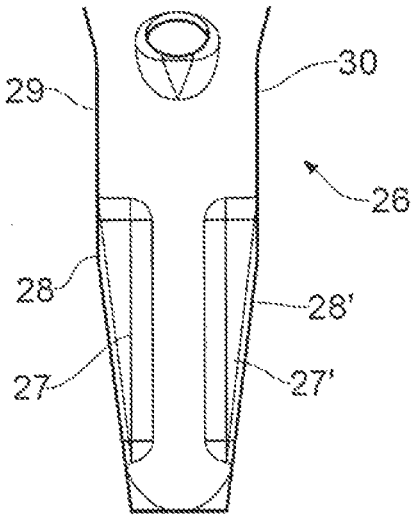
FIG. 2*b* shows a cross-sectional view of the tang portion of FIG. 2*a*.

Each turbine blade is cast from molten metal (e.g. a nickel-based super-alloy) using a directional solidification process. As seen in FIGS. 2*a* and 2*b*, the resulting cast component has a blade body 25 and two opposing tang portions 26 (only one shown).

The anterior surface 29 of the tang portion 26 comprises a series of elongated recesses 27 inter-spaced by a series of elongated ribs 28. The elongated recesses 27 and ribs 28 are axially aligned with the major axis (A-A) of the cast component. The posterior surface 30 of the tang portion 26 also comprises a series of elongated recesses 27' and ribs 28'.

The cross-sectional shape and/or cross-sectional area of the interspaced elongated ribs 28 may vary along the length of each rib. Examples of possible cross-sectional shapes (at 90 degrees to the direction of elongation/major axis (A-A) of the cast component) for the interspaced elongated ribs 28 are shown in FIGS. 3*a-e*.

Figure 3A:
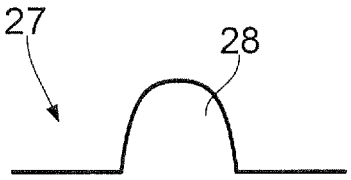
FIGS. 3*a-e* show possible cross-sectional shapes for the elongated ribs shown in FIGS. 2*a* and 2*b*.
Figure 3B:
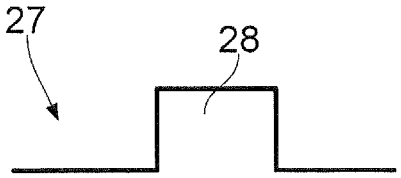
Figure 3C:
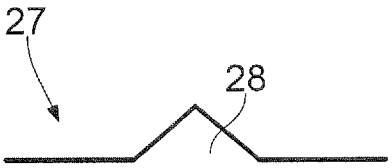
Figure 3D:
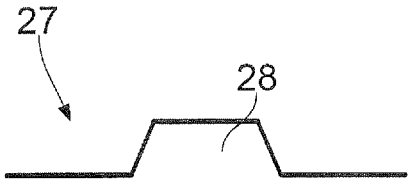
Figure 3E:
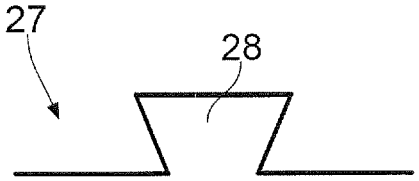

FIG. 3*a*, shows an elongated rib 28 with a semi-circular-shaped cross-section. FIG. 3*b*, shows an elongated rib 28 with a square-shaped cross-section. FIG. 3*c*, shows an elongated rib 28 with a triangular-shaped cross-section. FIG. 3*d*, shows an elongated rib 28 with a trapezoidal-shaped cross-section. FIG. 3*e*, shows an elongated rib 28 with a dovetail cross-section. The apices of the cross-sectional shapes shown in FIGS. 3*b*, 3*c*, 3*d* and 3*e* may optionally be rounded.

Figure 4A:
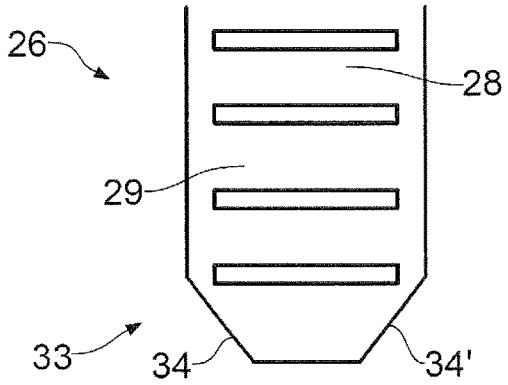
FIGS. 4*a* and 4*b* show second and third embodiments of a tang portion with alternative arrangements for the series of elongated recesses.
Figure 4B:
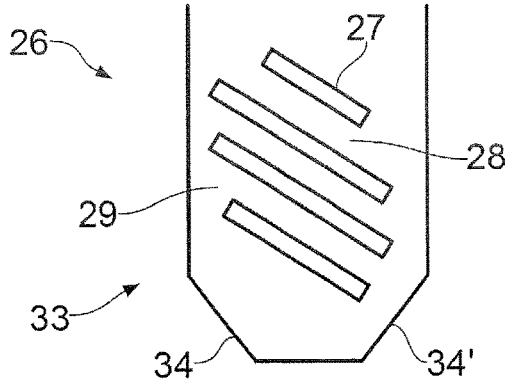

Alternative arrangements for the series of elongated recesses 27 inter-spaced by a series of elongated ribs 28 are shown in FIGS. 4*a* and 4*b*. In FIG. 4*a*, the elongated recesses 27 and ribs 28 are aligned transverse to the major axis (A-A) of the cast component, i.e. at 90 degrees to the major axis. In FIG. 4*b*, the elongated recesses 27 and ribs 28 are aligned at substantially 45 degrees to the major axis (A-A) of the cast component.

In the embodiments, shown in FIGS. 4*a* and 4*b*, the elongated recesses 27 are entirely contained within the anterior surface 29 of the tang portion 26.

Figure 5:
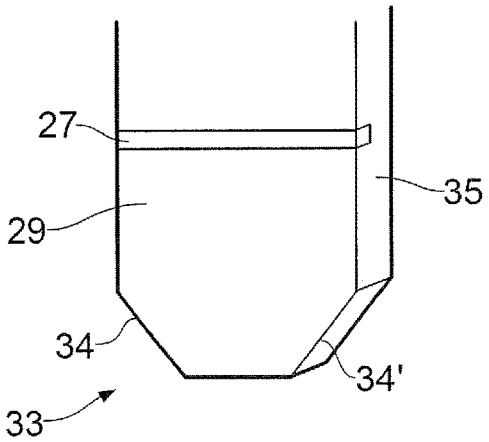
FIG. 5 shows a fourth embodiment of a tang portion with a recess extending into a side surface.

As shown in FIG. 5, one or more of the elongated recesses 27 may extend into a side surface 35 of the tang portion 26, the side surface 35 separating the anterior and posterior surfaces 29, 30.

Figure 6A:
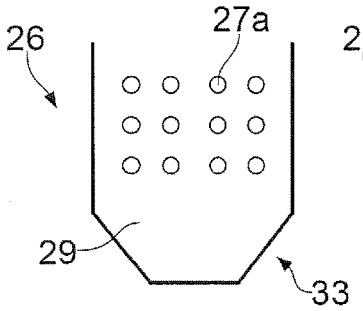
FIGS. 6*a*-6*i* show further embodiments of a tang portion with shaped recesses.
Figure 6B:
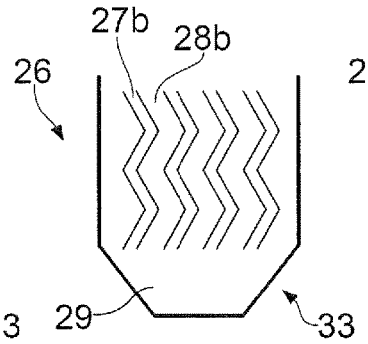
Figure 6C:
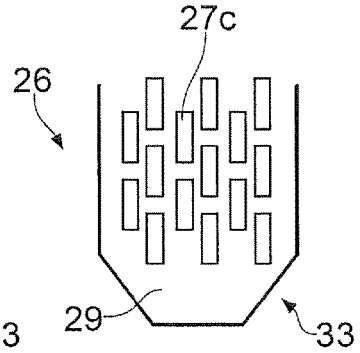
Figure 6D:
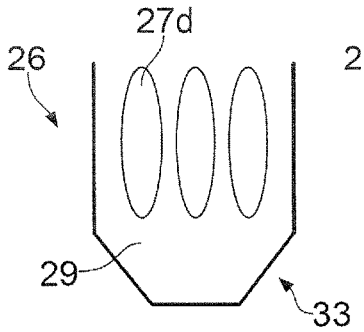
Figure 6E:
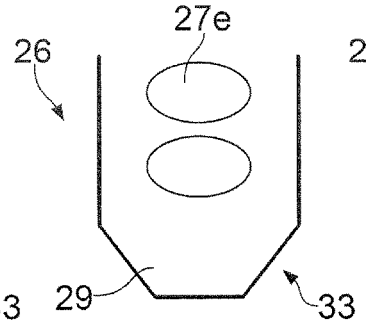
Figure 6F:
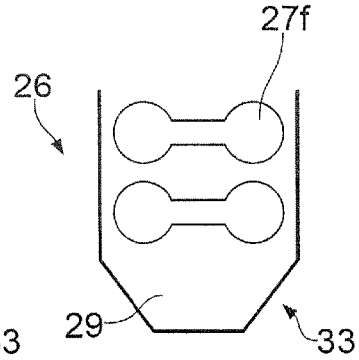

FIGS. 6*a-i* show alternative arrangements for the series of recesses. In FIG. 6*a*, the recesses are spaced circular recesses 27*a*, axially and transversely aligned with the major axis of the component. In FIG. 6*b*, the recesses are elongated zig-zagged, axially aligned recesses 27*b* interspaced by elongated zig-zagged, axially aligned ribs 28*b*. In FIG. 6*c*, the recesses are a series of rows of axially aligned, staggered rectangles 27*c*. In FIG. 6*d*, the recesses are a series of axially aligned ovular recesses 27*d*. In FIG. 6*e*, the recesses are a series of transversely aligned ovular recesses, 27*e*. In FIG.

Figure 6G:
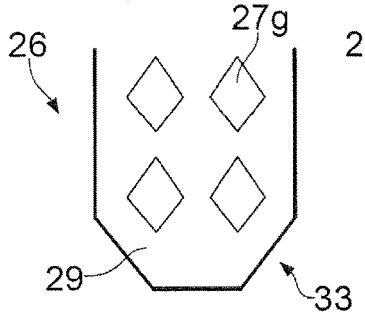
Figure 6H:
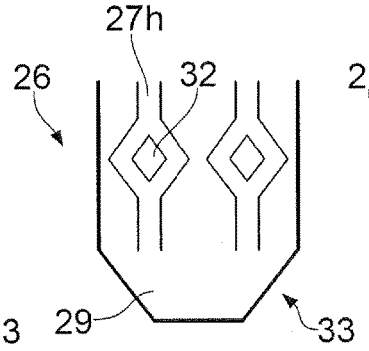
Figure 6I:
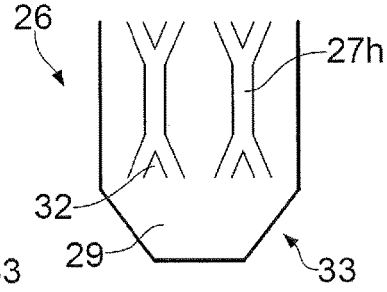

6*f*, the recesses are a series of transversely aligned dog-bone recesses, 27*f*. In FIG. 6*g*, the recesses are spaced diamond-shaped recesses 27*g*, axially and transversely aligned with the major axis of the component. In FIGS. 6*h* and 6*i*, the recesses are elongated, axially aligned branched recesses 27*h* with the branch portions at least partly surrounding projections 32 on the anterior surface 29.

The tip 33 of the anterior and posterior surfaces 29, 30 of the tang portion 26 is trapezoid-shaped. The angle of the two sloped edges 34, 34' is between 50 and 70 degrees to the vertical (where the vertical is at 90 degrees to the parallel edges).

The tang portion is used to support the cast component during finishing and the tang portion is subsequently clipped from the cast component to form the turbine blade 24 for incorporation into the turbines 16, 17, 18 of the engine.

The directional solidification process used for forming the cast component comprises forming a mould comprising a main body defining a cavity corresponding in shape to the blade body 25 and at least one mould portion defining a cavity with a reduced cross-sectional area corresponding in shape to the tang portion 26.

The mould portion defining the tang cavity comprises the recess or series of recesses and ribs corresponding to those shown in FIGS. 2*a-b*, 3*a-e*, 4*a-b*, 5 and 6*a-i* since these recesses and ribs will define the recesses/ribs on the tang portion 26 of the cast component.

The mould portion defining the tang cavity will be interposed between the main body of the mould and a selector portion, the selector portion defining a cavity corresponding to the shape of the pig-tail selector.

During the directional solidification process, molten metal will be poured into the mould and the mould slowly withdrawn (selector portion first) from a heating zone of a vacuum furnace into a cooling zone of the furnace towards an end chill plate. As the mould portion defining the tang cavity enters the cooling zone, the increased surface area of the mould portion and the reduced thermal mass of the portion of the cast component within the mould portion results in increased radiative heat loss from the mould portion. This, in turn, results in a high thermal gradient across the solid/liquid metal interface which minimises defects in the single crystal structure of the component.

In the embodiments shown in FIGS. 2*a-b*, 6*b-d* and 6*g-i*, the radiation of heat from the increased surface area is predominantly towards the walls of the cooling zone rather than the chill plate. This is because the increased surface area of the mould portion faces the walls of the cooling zone rather than the chill plate i.e. there is an increased view factor towards the walls of the cooling zone rather than towards the chill plate.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A mould for casting a component using a directional solidification process, said mould comprising a mould portion which defines a shape of an element to be removed from the component in a subsequent manufacturing step, the mould portion being positioned at an end of the mould and defining a cavity with a reduced cross-sectional area reduced relative to a cross-sectional area of at least one other cavity of the mould, wherein the mould portion comprises at least one recess which further reduces the reduced cross sectional area of the cavity of the mould portion and increases a surface area of the mould portion or a plurality of projections which increase the surface area of the mould portion, such that, in use, a radiative heat loss from said mould portion during said directional solidification process is increased.

2. A mould according to claim 1 wherein the mould portion comprises a plurality of recesses.

3. A mould according to claim 2 wherein the plurality of recesses are elongated recesses and are separated by one or more interspaced elongated projecting ribs.

4. A mould according to claim 1 wherein the mould portion comprises a plurality of projections and the projections are elongated projecting ribs.

5. A mould according to claim 1 wherein the plurality of projections have a semi-circular-, square-, triangular-, trapezoidal-, or dovetail-shaped cross section (at 90 degrees to a direction of elongation of the projection).

6. A mould according to claim 1 wherein the recesses and/or projections have a major axis, and this axis is arranged parallel to a major axis of the mould portion.

7. A mould according to claim 1 wherein the recesses and/or projections have a major axis, and this axis is transversely aligned with a major axis of the mould portion.

8. A mould according to claim 1 wherein the recesses and/or projections are arranged in zig-zag pattern.

9. A mould according to claim 1 wherein the recesses and/or projections are branched.

10. A mould according to claim 1 wherein the or each recess or at least one of said plurality of projections is circular-, ovular-, diamond- or dog-bone-shaped.

11. A mould according to claim 1 wherein the mould portion has a posterior and anterior surface and the recess or series of recesses or plurality of projections/elongated projecting ribs is provided on one or both of said surfaces.

12. A mould according to claim 1 wherein the element defined by the mould portion is positioned to support the component during the subsequent manufacturing step.

13. A mould for casting a turbine blade using a directional solidification process, said mould comprising a mould portion which defines a shape of an element to be removed from the turbine blade in a subsequent manufacturing step, the mould portion being positioned at an end of the mould and defining a cavity with a reduced cross-sectional area reduced relative to a cross-sectional area of at least one other cavity of the mould, wherein the mould portion comprises at least one recess which further reduces the reduced cross sectional area of the cavity of the mould portion and increases a surface area of the mould portion or a plurality of projections which increase the surface area of the mould portion, such that, in use, a radiative heat loss from said mould portion during said directional solidification process is increased, wherein the mould comprises a main body defining a cavity for forming a blade body and the mould portion defining the cavity with a reduced cross-sectional area is for forming a tang portion of the turbine blade to be removed during subsequent manufacturing steps.

14. A method of casting a component using a directional solidification process comprising:

forming a mould portion of a mould, the mould portion defining a cavity with a reduced cross-sectional area reduced relative to a cross-sectional area of at least one other cavity of the mould, the mould portion being positioned at an end of the mould and defining a shape of an element to be removed from the component in a subsequent manufacturing step; and forming at least one recess in the mould portion which further reduces the reduced cross sectional area of the cavity of the mould portion and increases a surface area of the at least one mould portion or a plurality of projections in the mould portion which increase the surface area of the mould portion thereby increasing radiative heat loss from said mould portion during said process.

15. A method according to claim 14 wherein forming at least one recess includes forming a plurality of recesses.

16. A method according to claim 15 wherein the recesses are a series of elongated recesses separated by one or more interspaced elongated ribs on the mould portion.

17. A method according to claim 14 wherein the plurality of projections comprises a plurality of elongated projecting ribs.

18. A method according to claim 17 wherein the plurality of elongated projecting ribs each has a semi-circular-, square-, triangular-, trapezoidal-, or dovetail-shaped cross section (at 90 degrees to the direction of elongation).

19. A method according to claim 14 further comprising forming the at least one recess or the plurality of projections parallel to a major axis of the mould portion.

20. A method according to claim 14 further comprising forming the at least one recess or the plurality of projections to be transversely aligned with a major axis of the mould portion.

21. A method according to claim 14 wherein the at least one recess or at least one of plurality of projections is zig-zagged.

22. A method according to claim 14 wherein the at least one recess is branched with the branches at least partly surrounding a protrusion on the mould portion or wherein at least one of the plurality of projections is branched.

23. A method according to claim 14 wherein the at least one recess or at least one of the plurality of projections is a circular-, ovular-, diamond- or dog-bone-shaped recess or projection.

24. A method according to claim 14 wherein there is a series of recesses which are parallel to and/or transversely aligned with a major axis of the at least one mould portion or the plurality of projections/elongated projecting ribs are parallel to and/or transversely aligned with the major axis of the mould portion.

25. A method according to claim 14 wherein the mould portion has a posterior and an anterior surface and the at least one recess or plurality of projections is provided on one or both of said surfaces.

26. A method according to claim 14 for casting a turbine blade wherein the mould comprises a main body defining a cavity for forming a blade body and the mould portion defining the cavity with a reduced cross-sectional area is for forming a tang portion of the turbine blade.

27. A method according to claim 14 wherein the element defined by the mould portion is positioned to support the component during the subsequent manufacturing step.

* * * * *